US008479618B2

(12) United States Patent
Hsiao

(10) Patent No.: US 8,479,618 B2
(45) Date of Patent: Jul. 9, 2013

(54) LOCKING PLIERS HAVING BOTH FAST AND FINE ADJUSTMENT TO JAW SPACING

(76) Inventor: Kuei-Chueh Hsiao, Taiping (TW)

( * ) Notice: Subject to any disclaimer, the term of this patent is extended or adjusted under 35 U.S.C. 154(b) by 334 days.

(21) Appl. No.: 12/890,719

(22) Filed: Sep. 27, 2010

(65) Prior Publication Data

US 2012/0073409 A1 Mar. 29, 2012

(51) Int. Cl.
*B25B 7/12* (2006.01)
*B25B 7/04* (2006.01)

(52) U.S. Cl.
USPC ..... 81/370; 81/384

(58) Field of Classification Search
USPC ..... 81/367–380, 384
See application file for complete search history.

(56) References Cited

U.S. PATENT DOCUMENTS 2,341,654 A * 2/1944 Richter ..... 81/368
2,587,673 A * 3/1952 Aden ..... 81/375
2,681,583 A * 6/1954 Buschman ..... 81/368
4,275,623 A * 6/1981 Walter ..... 81/367
2002/0157507 A1* 10/2002 Chou ..... 81/367

* cited by examiner

*Primary Examiner* — Hadi Shakeri
(74) *Attorney, Agent, or Firm* — Leong C. Lei

(57) ABSTRACT

The pair of locking pliers contains a seesaw member pivotally joined to a back end of a first handle; and an adjustment member capable of sliding up and down within the first handle. The adjustment member contains an adjustment body and an adjustment bolt axially and rotatably threading through the adjustment body. The seesaw member contains a seesaw handle and a torsion spring engaging the seesaw handle so that a first chain of teeth of the seesaw handle engages or disengages a second chain of teeth along the adjustment body to lock the adjustment body or to allow the adjustment body to slide up and down. When the adjustment body slides, a spacing between the jaws of the locking pliers are adjusted quickly. When the adjustment body is locked by the seesaw handle, the adjustment bolt is twisted to fine-tune the jaw spacing.

3 Claims, 7 Drawing Sheets

LOCKING PLIERS HAVING BOTH FAST AND FINE ADJUSTMENT TO JAW SPACING

(a) TECHNICAL FIELD OF THE INVENTION

The present invention generally relates to locking pliers, and more particular to a pair of locking pliers where the jaw spacing could be quickly adjusted to a desired range and then fine-tuned to precisely fit on an object to be operated.

(b) DESCRIPTION OF THE PRIOR ART

For conventional locking pliers, a bolt threading into the end of a first handle is used, by screwing in or out, to raise or lower a lever between the first handle and a second handle so as to adjust the spacing of the jaws. The conventional pliers have a number of disadvantages. First, there is often a limitation on how far apart the jaws could be. Secondly, each turn of the bolt, due to a small thread pitch, only enlarge or shrink the jaw spacing a little. The locking pliers are therefore tedious to operate. Thirdly, for a similar reason, the jaw spacing could not be immediately adjusted to fit on a new object to be gripped. Fourthly, after a period of use, the threads are worn out and the allowance is increased, making the pliers' grip less reliable. In addition, also due to the threads' wearing out, the operation life of the pliers is reduced.

SUMMARY OF THE INVENTION

Therefore, a major objective of the present invention is to provide a pair of locking pliers where the jaw spacing could be quickly adjusted to a desired range by vertically sliding an adjustment member.

Another major objective of the present invention is to provide a pair of locking pliers where, once the jaw spacing is within the desired range, a seesaw member locks the adjustment member and the adjustment member could fine-tune the jaw spacing so as to fit the locking pliers on the object to be operate.

To achieve the objectives, the seesaw member is pivotally joined to a back end of the first handle; and the adjustment member is capable of sliding up and down within the first handle. The adjustment member contains an adjustment body and an adjustment bolt axially and rotatably threading through the adjustment body. The seesaw member contains a seesaw handle and a torsion spring engaging the seesaw handle so that a first chain of teeth of the seesaw handle engages or disengages a second chain of teeth along the adjustment body to lock the adjustment body or to allow the adjustment body to slide up and down. When the adjustment body slides, a spacing between the jaws of the locking pliers are adjusted quickly. When the adjustment body is locked by the seesaw handle, the adjustment bolt is twisted to fine-tune the jaw spacing.

The advantages of the present invention are as follows. First, the pair of locking pliers provides both fast and fine adjustment to the jaw spacing, making the use of the locking pliers significantly more convenient than the prior arts. Secondly, by avoiding the troublesome and continuous small-pitch adjustment performed by the prior arts, the present invention provides large-ranged adjustment so that the threads and grooves suffer only reduced amount of wear, leading to a prolonged operational life.

The foregoing objectives and summary provide only a brief introduction to the present invention. To fully appreciate these and other objects of the present invention as well as the invention itself; all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
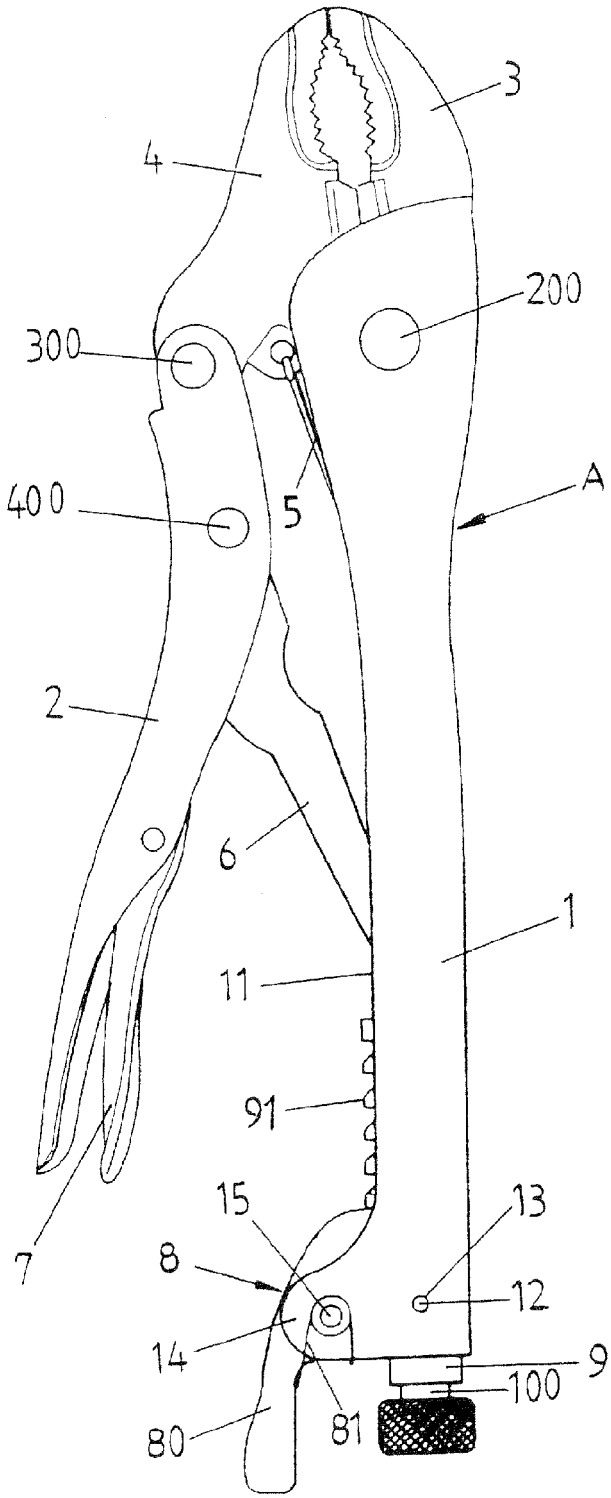
FIG. 1 is a schematic diagram showing a pair of locking pliers according to an embodiment of the present invention
Figure 2:
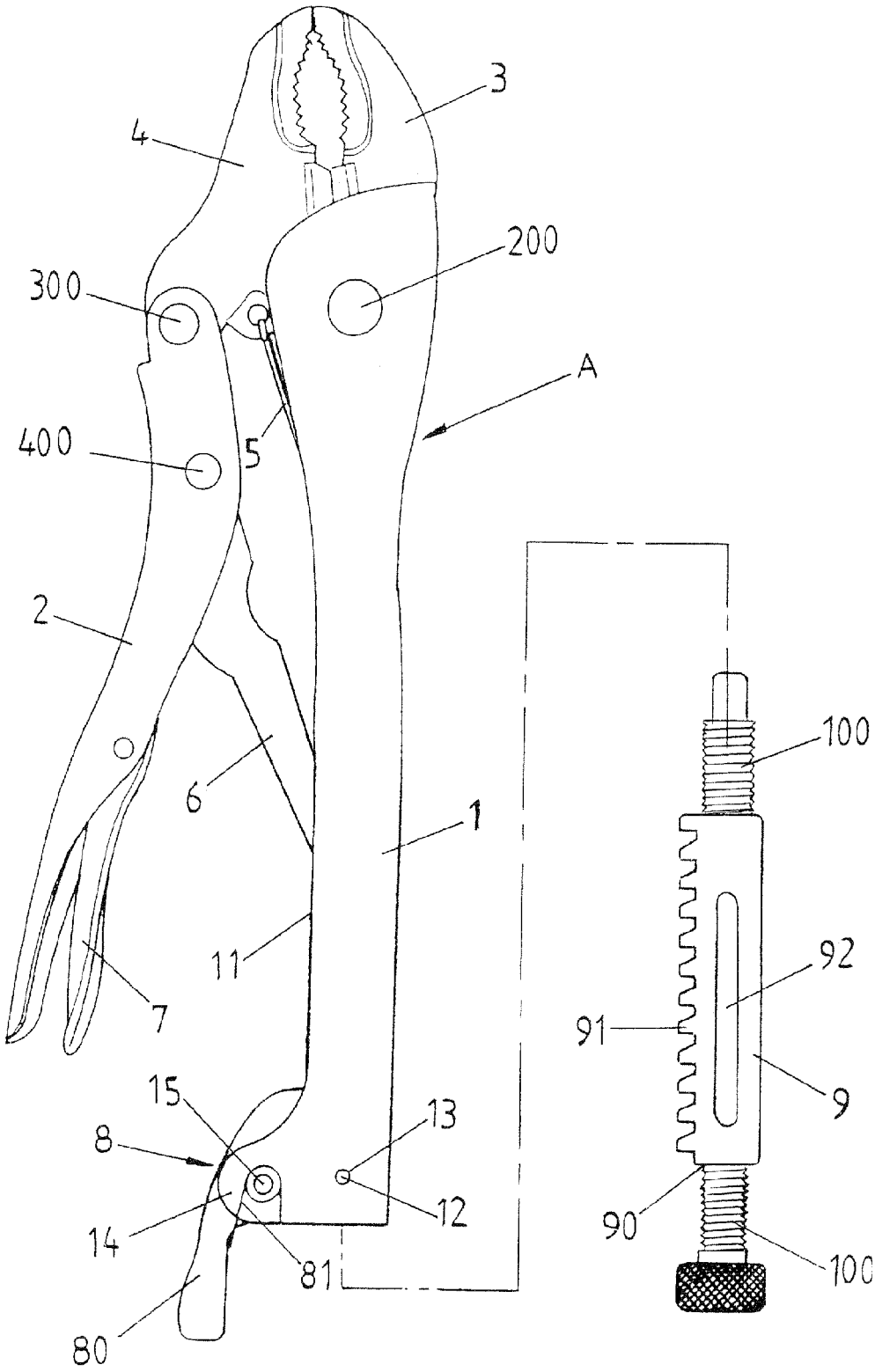
FIG. 2 is a schematic diagram showing an adjustment member of the locking pliers of FIG. 1.
Figure 3:
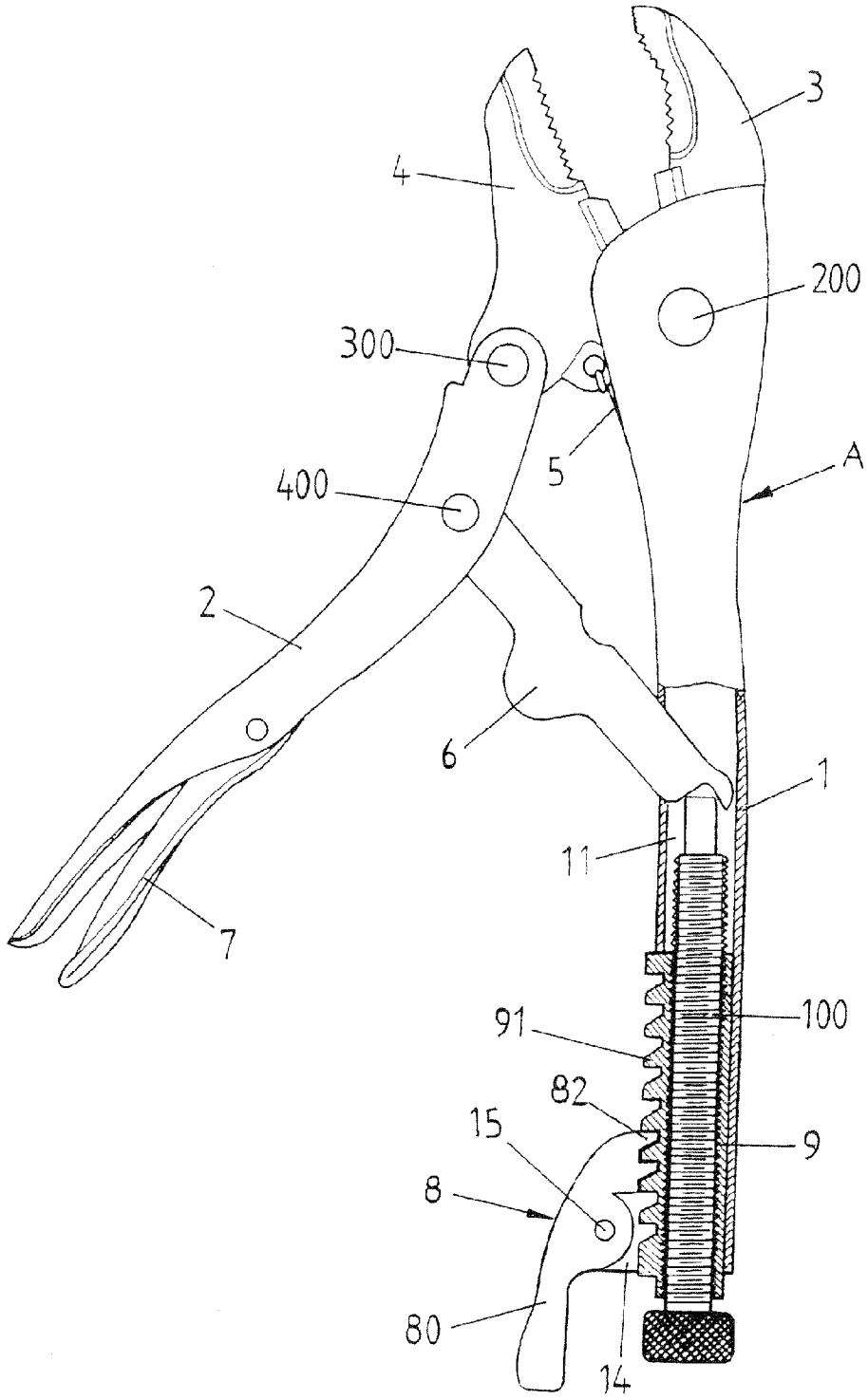
FIG. 3 is a schematic diagram showing the adjustment member of FIG. 2 housed in the locking pliers of FIG. 1.

As shown in FIGS. 1 to 3, a pair of locking pliers A according to an embodiment of the present invention contains a first handle 1 and a second handle 2, a first jaw 3 and a second jaw 4 in front of the first and second handles 1 and 2, respectively, a tension spring 5, a lever 6 between the first and second handles 1 and 2, a third handle 7 on the second handle 2 engaging the lever 6, and a seesaw member 8 at a back end of the first handle 1. A first jaw 3 is fixedly and integrally joined to a front end of the first handle 1 by a flat-head rivet 200. Along an inner side of the first handle 1, a longitudinal groove 11 is configured within which an adjustment member is configured. The adjustment member contains an adjustment body 9 with an axial channel 90 and an adjustment bolt 100 threading through the channel 90. The channel 90 and the adjustment bolt 100 have corresponding threads and grooves. Along an inner edge of the adjustment body 9, a chain of teeth 91 are configured, each having a flat bottom edge for blocking and a slant top edge for fast advancement. Also along a side edge of the adjustment body 9, a limiting groove 92 is configured where a pin 12 threading through a hole 13 at the back end of the first handle 1 is embedded. As such, the adjustment body 9 could slide up and down within a range without falling out of the first handle 1. Please note that the first handle 1 could have a circular or rectangular cross-section so as to accommodate a corresponding cylindrical or cubic adjustment body 9.

The second jaw 4 is pivotally joined to a first end of the second handle 2 also by a flat-head rivet 300. An end of the tension spring 5 is connected to the second jaw 4 and the other end of the tension spring 5 is connected to the first handle 1.

The lever 6 has a first end pivotally joined to the second handle 2 by a smaller flat-head rivet 400. A second end of the lever 6 is extended into the groove 11 of the first handle 1 against a top end of the adjustment bolt 100 threading through the channel 90 of the adjustment body 9 housed in the groove 11.

The seesaw member 8 is rotatably joined to a seat 14 at the back end of the groove 11 by a pin 15. The seesaw member 8 contains a seesaw handle 80 and a torsion spring 81 engaging the seesaw handle 80. A chain of teeth 82 having at least one tooth are configured along an outer edge of a top end of the seesaw handle 80. The chain of teeth 82 of the seesaw handle 80 engages the chain of teeth 91 of the adjustment body 9 within the first handle 1's groove 11.

Figure 7:
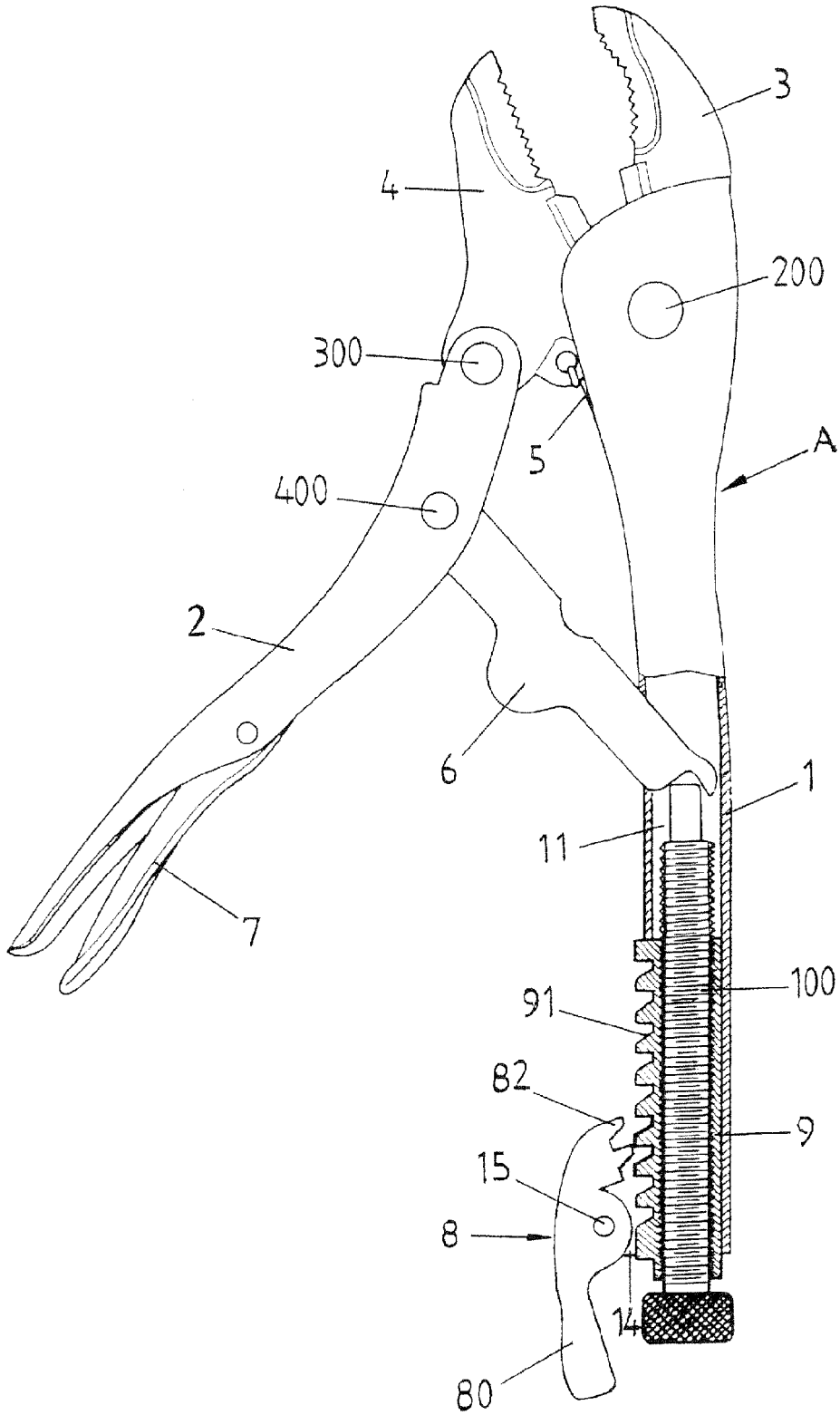
FIG. 7 is a schematic diagram showing the locking pliers of FIG. 1 when a seesaw handle disengages an adjustment body of the locking pliers.

As shown in FIG. 7, when a bottom end of the seesaw handle 80 is pressed and the torsion spring 81 is expanded, the top end of the seesaw handle 80 is moved away from the first handle 1 and the chain of teeth 82 disengages the adjustment body 9's chain of teeth 91. The adjustment body 9, along with the adjustment bolt 100, is free to slide up and down in the groove 11 of the first handle 1. When the adjustment body 9 slides upwards or downwards, the second end of the lever 6 is pushed upwards or downwards accordingly. The spacing between the second and first jaws 4 and 3 is as such quickly adjusted. When the spacing substantially reaches a desired distance, the bottom end of the seesaw handle 80 is released and the torsion spring 81 pulls the top end of the seesaw handle 80 so that the chain of teeth 82 engage the adjustment body 9's chain of teeth 91 again. The adjustment body 9 is then locked at the position and the adjustment bolt 100 is twisted to fine-tune the spacing of the second and first jaws 4 and 3 until it precisely fits on the object to be worked on.

Figure 4:
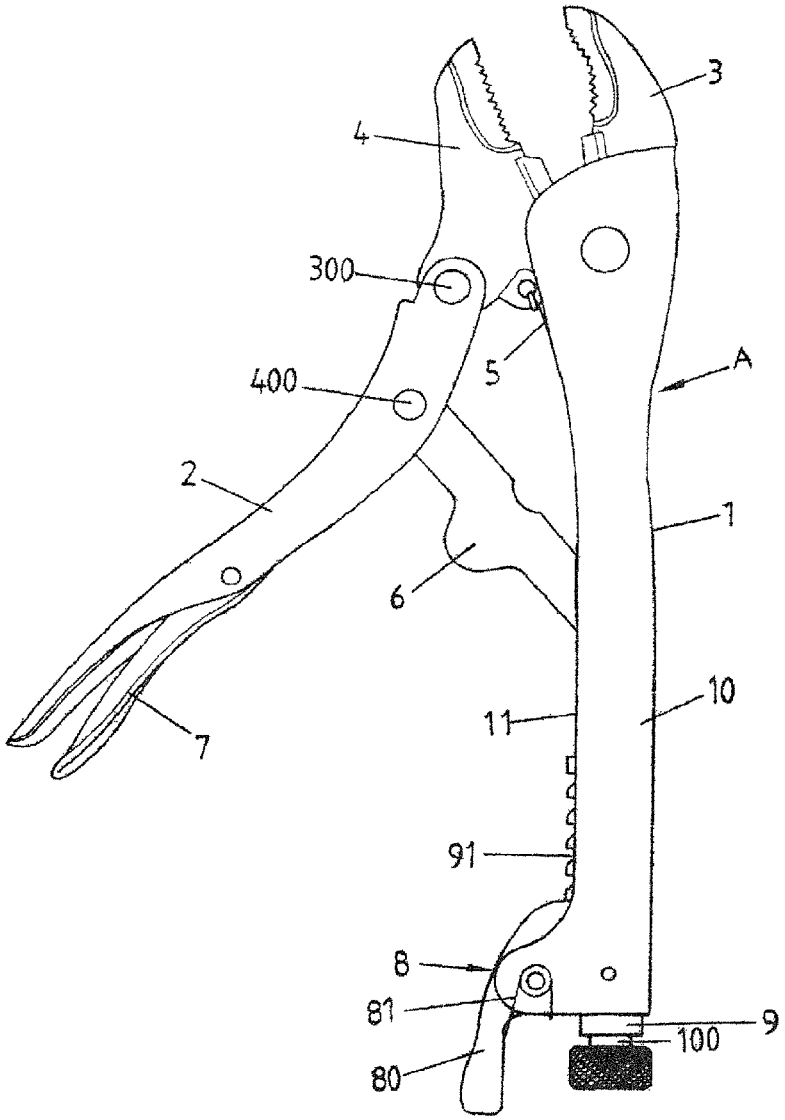
FIG. 4 is a schematic diagram showing the locking pliers of FIG. 1 when the first and second jaws are completely closed together.
Figure 5:
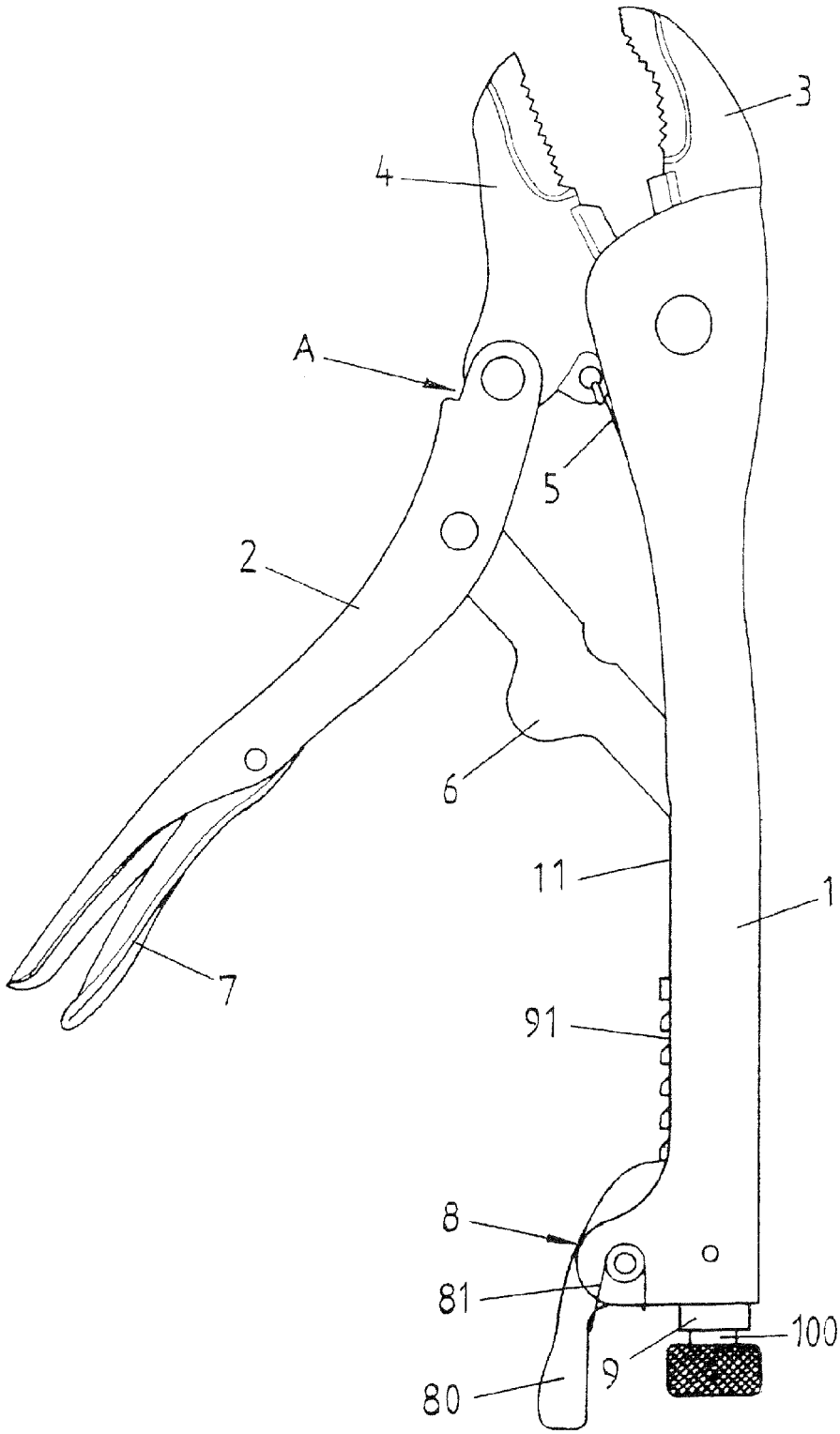
FIG. 5 is a schematic diagram showing the locking pliers of FIG. 1 when the second handle is not pressed and the second jaw is not closed to the first jaw.

FIG. 4 shows the locking pliers A when the first and second jaws 3 and 4 are completely closed together. FIG. 5 shows the locking pliers A when the second handle 2 is not pressed and the second jaw 4 is not closed to the first jaw 3. For the configuration of FIG. 4, the adjustment body 9 is completely inside the first handle 1 and the top end of the adjustment bolt 100 pushes the lever 6 so that the second handle 2 and the jaw 4 are closed to the first handle 1 and the first jaw 3.

Figure 6:
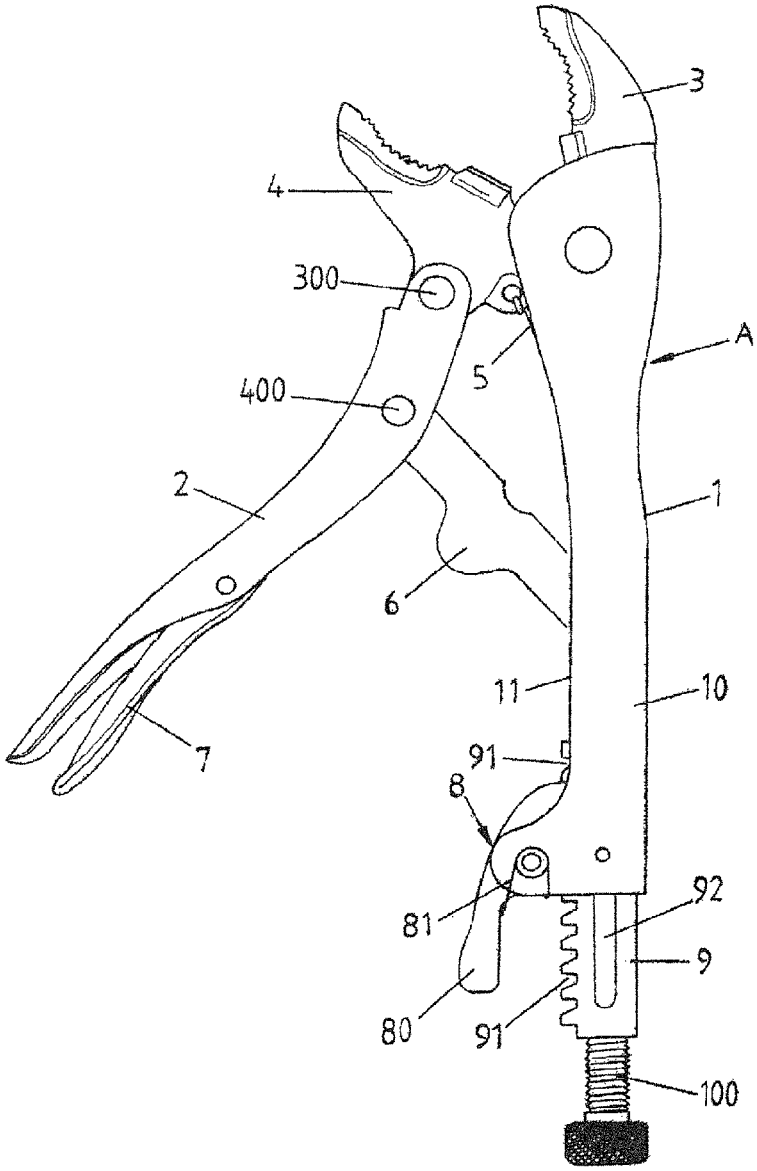
FIG. 6 is a schematic diagram showing the locking pliers of FIG. 1 when the first and second jaws are farthest apart.

FIG. 6 is a schematic diagram showing the locking pliers A when the first and second jaws 3 and 4 are farthest apart. Here the chain of teeth 82 of the seesaw handle 80 disengages the adjustment body 9's chain of teeth 91. The adjustment body 9, along with the adjustment bolt 100, could slide up and down in the groove 11 of the first handle 1 to quickly adjust the spacing between the second and first jaws 4 and 3.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A pair of locking pliers, comprising a first handle; a second handle; a first jaw and a second jaw at a top end of said first and second handles, respectively; a first spring between said second jaw and said first handle; a lever between said first and second handles, a third handle on said second handle engaging said lever; a seesaw member pivotally joined to a back end of said first handle; and an adjustment member capable of sliding up and down within said first handle;

wherein said adjustment member contains an adjustment body and an adjustment bolt axially and rotatably threading through said adjustment body;

along a side edge of said adjustment body, a limiting groove is configured where a pin threading through a hole at a back end of said first handle is embedded;

said seesaw member contains a seesaw handle and a second spring engaging said seesaw handle; said second spring engages said seesaw handle so that a first chain of teeth along a top end of said seesaw handle engages or disengages a second chain of teeth along a circumference of said adjustment body to lock said adjustment body or to allow said adjustment body to slide up and down; when said adjustment body slides and said lever is pushed upwards or downwards, a spacing between said first and second jaws are adjusted quickly; when said adjustment body is locked by said seesaw handle, said adjustment bolt is twisted so that a top end of said adjustment bolt raises or lowers said lever to fine-tune said spacing.

2. The pair of locking pliers according to claim 1, wherein said first handle has a rectangular cross-section; and said adjustment body has a matching cubic shape.

3. The pair of locking pliers according to claim 1, wherein said second spring is a torsion spring.

* * * * *